US006357706B1

(12) United States Patent
Fleckenstein

(10) Patent No.: US 6,357,706 B1
(45) Date of Patent: Mar. 19, 2002

(54) TRAY SUPPORT DEVICE

(76) Inventor: Mark A. Fleckenstein, 679 N. FM 51, Decatur, TX (US) 76234

( * ) Notice: Subject to any disclaimer, the term of this patent is extended or adjusted under 35 U.S.C. 154(b) by 0 days.

(21) Appl. No.: 09/567,378

(22) Filed: May 10, 2000

(51) Int. Cl.[7] ..... E06C 7/14; E04G 1/00

(52) U.S. Cl. ..... 248/210; 248/229.14; 248/312.1; 182/129

(58) Field of Search ..... 248/210, 211, 248/228.3, 229.14, 229.22, 231.41, 238, 312.1; 182/129

(56) References Cited

U.S. PATENT DOCUMENTS

| | | | | | |
|---|---|---|---|---|---|
| 2,308,805 | A | * | 1/1943 | Dahl | 248/211 |
| 2,967,691 | A | * | 1/1961 | Lehnbeuter et al. | 248/312.1 |
| 3,094,304 | A | * | 6/1963 | Linder, Jr. | 248/211 |
| 3,961,766 | A | * | 6/1976 | Brothers | 248/210 |
| 3,979,097 | A | * | 9/1976 | Balne | 248/211 |
| 4,025,016 | A | * | 5/1977 | Brothers | 248/210 |
| 4,222,541 | A | | 9/1980 | Cillis | |
| 4,476,984 | A | | 10/1984 | Garrett | |
| 4,623,113 | A | * | 11/1986 | Studebaker | 248/311.2 |
| 4,949,925 | A | * | 8/1990 | Gorecki | 248/238 |
| 4,979,710 | A | | 12/1990 | Baldwin | |
| 5,191,954 | A | | 3/1993 | Ledford | |
| 5,236,161 | A | | 8/1993 | Haven | |
| 5,305,977 | A | * | 4/1994 | Roth | 248/210 |
| 5,641,142 | A | | 6/1997 | Hanson et al. | |
| 5,853,156 | A | | 12/1998 | Moore et al. | |
| 5,855,346 | A | | 1/1999 | Hall | |

FOREIGN PATENT DOCUMENTS

JP 405141165 A * 6/1993

* cited by examiner

*Primary Examiner*—Anita King
*Assistant Examiner*—Naschica S. Morrison
(74) *Attorney, Agent, or Firm*—Lee, Mann, Smith, McWilliams, Sweeney and Ohlson

(57) ABSTRACT

An improved apparatus for adjustably attaching a tray to a ladder side member. The apparatus includes a first clamping member for attachment to a ladder, an L-shaped support having a support leg and a mounting leg perpendicular to the support leg, thereby forming the L-shape and first and second tray clamping members, which allow a tray to be securely fastened to a ladder The support leg provides support to the bottom of the paint container when the device is mounted to the ladder. The mounting leg is attached to the clamping assembly and is provided with elongated slots therein for bolts to pass therethrough. The bolts also pass through the clamping assembly. The bolts are provided with threaded knobs and are used to draw the first clamp, the first and second tray clamp members and the mounting leg of the L-shaped support together when tightened. An additional slot is provided so that the position of the clamping assembly can be adjusted with respect to the mounting leg to accommodate attachment to a front or back side support of the ladder.

9 Claims, 3 Drawing Sheets

TRAY SUPPORT DEVICE

BACKGROUND OF THE INVENTION

This invention is an improved paint tray support device that allows attachment of a tray to a ladder. The tray support device has improved features enhancing both operational characteristics including ease of ladder attachment, paint tray stability and further having geometry enabling the paint tray support device to be attached to a variety of different trays, of different manufacturers.

DESCRIPTION OF RELATED ART

A common problem encountered when painting on a ladder is the absence of a convenient support at the higher ladder elevations for paint, trays, rollers, brushes and the like within convenient reach of the workers. A number of prior art devices have addressed this problem by providing detachable trays for ladders.

In order to provide maximum utility and versatility the supporting structure for a ladder tray should be easily demountable, equally suited for mounting on the left or right hand side of a ladder, and possess means for adjusting the angle of the attached tray to compensate for changes in ladder angle. Further economic and utilitarian advantages are realized by providing a detachable tray supporting structure having simply constructed mounting and adjusting means capable of inexpensive fabrication and easy operation. The means by which a tray support structure is attached to a ladder should be adaptable to fit all types and sizes of ladders commonly in use, such as wood, aluminum or fiberglass, by means of simple adjustment.

Although numerous prior art ladder trays and ladder tray supporting structures have been developed to solve certain of the aforementioned problems, none have adequately resolved all of the problems. As will become apparent from the discussion which follows, however the present invention solves each of the previously mentioned problems in a simple, inexpensive and expedient manner.

SUMMARY OF THE INVENTION

In a preferred embodiment, the invention may be described as a tray support device adapted to be adjustably attached to a ladder for supporting a tray containing paint or other liquid. The device includes a clamping assembly for attachment to a ladder and a tray, and an L-shaped support having a support leg and a mounting leg perpendicular to the support leg, thereby forming the L-shape. The support leg provides support to the bottom of the paint container when the device is mounted to the ladder. The mounting leg is attached to the clamping assembly. This mounting arrangement of the invention can be readily adjusted by the user to ensure that an attached tray can be maintained in a position level with the ground regardless of changes in ladder angle.

The clamping assembly includes a first clamping member positioned adjacent to an outside surface of the mounting leg and two tray clamp members positioned adjacent to an inside surface of the mounting leg. The first clamping member cooperates with the outside surface of the mounting leg of the L-shaped support to capture the side rail of the ladder therebetween. The first clamping member has the ability to be clamped to the side rails of aluminum, wood, fiberglass, and other types of ladders without undue stress on or deformation of the rails. The two tray clamp members are positioned adjacent to an inside surface of the mounting leg of the L-shaped support and cooperate to capture the lip and a portion of the sidewall of the paint tray therebetween. This assembly allows the paint container to be adjustably positioned at any vertical location of the ladder and is adaptable to various types of trays. It also allows for positioning of the container on either side of the ladder to accommodate both right and left-handed painters. Additionally, the assembly provides a universal mounting arrangement to accommodate most common types of ladders.

DETAILED DESCRIPTION OF THE PREFERRED EMBODIMENT

While the present invention will be described fully hereinafter with reference to the accompanying drawings, in which a particular embodiment is shown, it is to be understood at the outset that persons skilled in the art may modify the invention herein described while still achieving the desired result of this invention. Accordingly, the description which follows is to be understood as abroad informative disclosure directed to persons skilled in the appropriate arts and not as limitations of the present invention.

Figure 1:
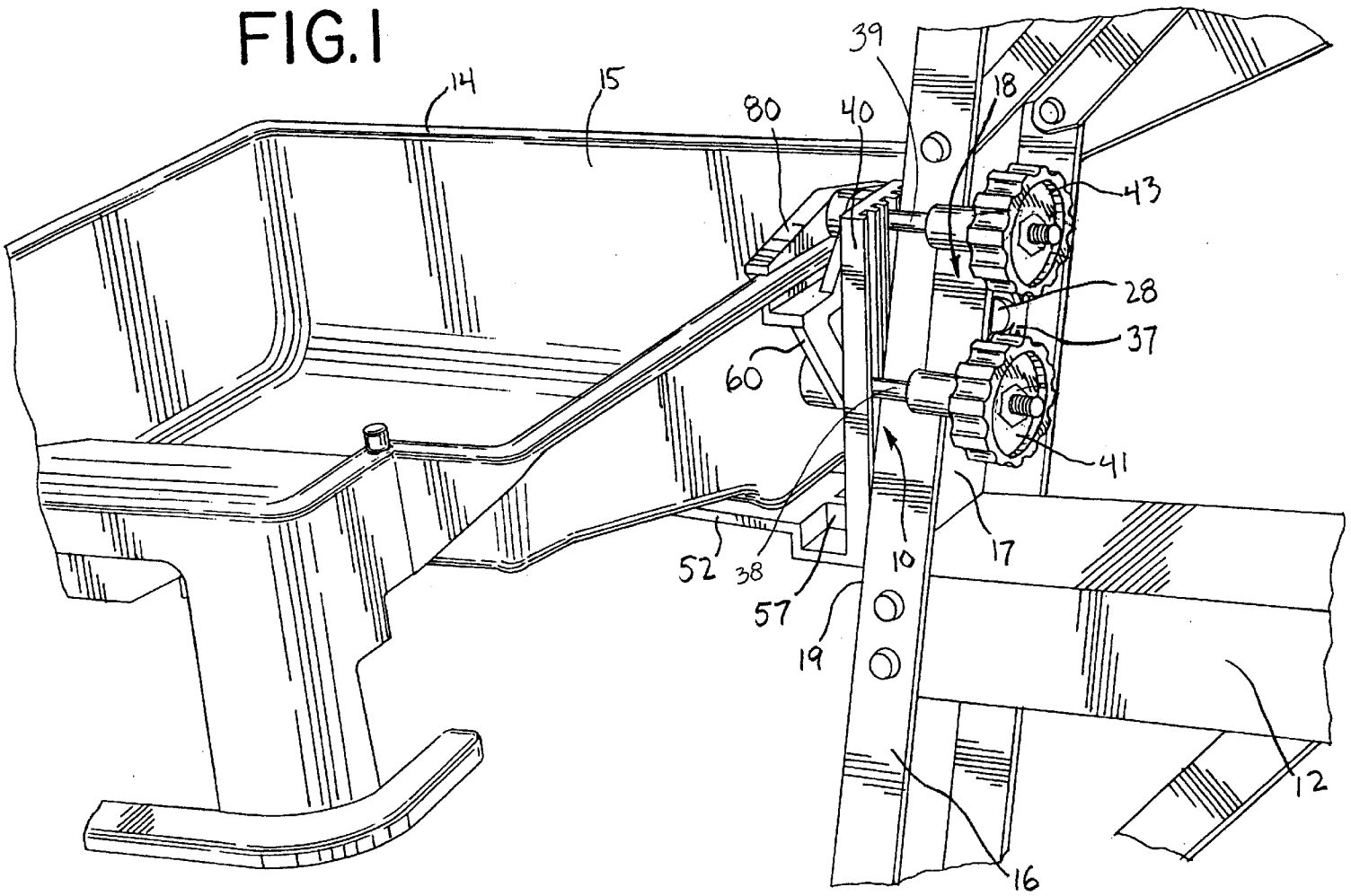
FIG. 1 is a perspective view of the paint tray support device showing the attachment of the device to a tray and a ladder

A preferred embodiment of the tray support device 10 of the present invention is shown in FIG. 1 attached to a ladder 12 and a tray 14. The tray support device 10 is adapted to removably mount the tray 14 to the ladder 12. The tray support device 10 is also adapted to releasably attach to a variety of ladders including free standing, extension and the like constructed out of materials such as metal, wood and fiberglass, having either a solid or channel configuration.

The tray support device 10 releasably attaches to a side rail 16 of the ladder 12. The tray 14, which may contain paint or other liquid, releasably attaches to the tray support device 10 and is positioned so the tray 14 is parallel to the ground to prevent the contents from spilling.

Figure 4:
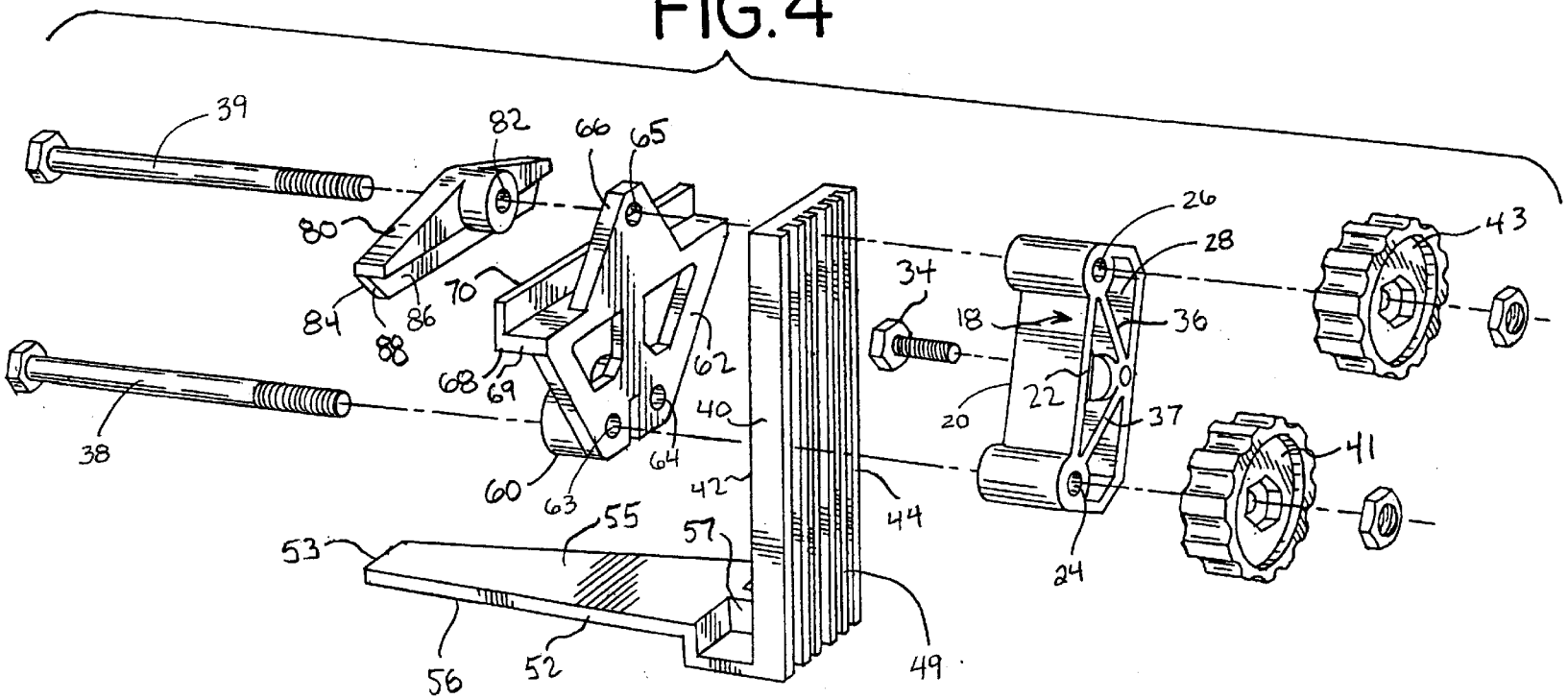
FIG. 4 is an exploded view of the paint tray support device illustrated in FIG. 1

The tray support 10 includes a first clamping member 18, a L-shaped support 50, a first tray clamp member 60, a second tray clamp member 80 and a pair of fasteners 38 and 39 with adjustment knobs 41 and 43. The first clamping member 18, as best shown in FIG. 4, includes a front surface 20, a rear surface 22 and a pair of apertures 24 and 26. The front surface 20 opposes the rear surface 22 and is spaced apart from the rear surface 22 by a gap 28. The front surface 20 has a smooth finish but may incorporate a textured finish to provide additional friction when attached to the side rail 16 of the ladder 12. The front surface 20 further includes a flange, not shown, that extends perpendicularly and outwardly along one edge of the front surface 20. The front surface 20 further includes a groove, not shown, that extends along the length of the face adjacent to the flange. The front surface 20 further includes an adjustable bolt 34 extending vertically from the front surface 20 centrally located on the edge opposite flange. The rear surface 22 includes a pair of ribs 36 and 37 to strengthen the first clamping member 18. Apertures 24 and 26 are positioned at opposite ends of the edge containing flange. Apertures 24 and 26 allow for a pair of fasteners 38 and 39 to pass through in a position that is perpendicular to both the front surface 20 and the rear surface 22. When the tray support device 10 is attached to the ladder 12, the front surface 20 comes into contact with an inside surface 17 of the side rail 16, shown in FIG. 1, to prevent the tray support device 10 from moving when the tray 14 is attached to the ladder 12 for use. Unlike a wooden ladder, an aluminum or fiberglass ladder side rail is a hollow, 3-sided channeled member with the channel facing the center of the ladder. When the first clamping member 18 is engaged to the ladder side rail 16 the groove, not shown, comes in contact with the edge of the side rail 16 channel and the adjustable bolt 34 comes in contact with the bottom of the side rail 16 channel. When properly attached, the first clamping member 18, with the aid of the adjustable bolt 34 if necessary, prevents the tray support device 10 from moving when the tray 14 is attached and in use. When the tray support device 10 is attached to a solid ladder, such as one constructed out of wood which does not have a channel configuration, the adjustable bolt 34 can be removed from the front surface 20 of the first clamping member 18 thereby allowing the front surface 20 to come into direct contact with the inside surface 17 of the ladder side rail 16.

Figure 3:
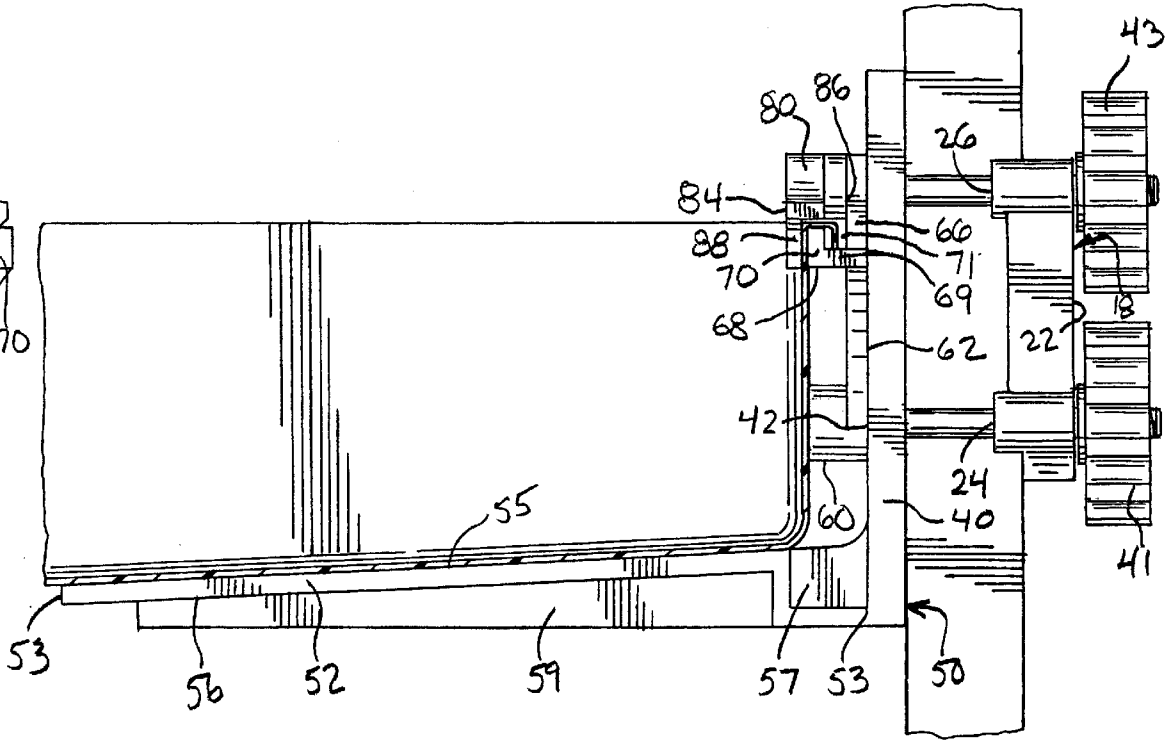
FIG. 3 is a side view of the paint tray support device illustrated in FIG. 1.
Figure 2:
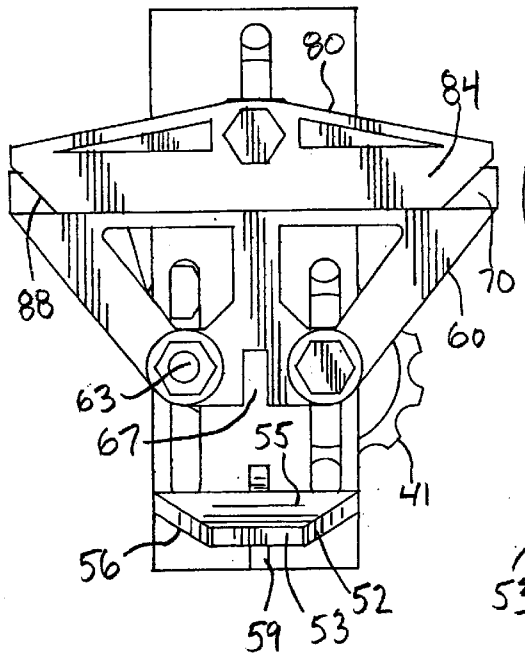
FIG. 2 is a front view of the paint tray support device illustrated in FIG. 1 not connected to the tray.

The L-shaped support 50, as shown in FIG. 3, includes a support leg 52 and a mounting leg 40 perpendicularly connected to the support leg 52 thereby forming an L-shape. The support leg 52 includes a top surface 55 and a bottom surface 56. The support leg 52 has an attached end 51 and a free end 53 wherein the attached end is connected to the mounting leg 40 and extends outwardly. As the support leg 52 extends outwardly, the width gradually tappers so the free end 53 is narrower than the attached end 51. A recess 57 is defined between the inner surface 42 of the mounting leg 40 and the support leg 52. A support leg rib 59 is attached to the bottom surface 56 of ate support leg 52 and is connected to the inner surface 42 of the mounting leg 52 and passes perpendicularly through the center of the recess 57. The recess 57 is to extend the range of travel of the first tray clamp member 60 so a tray 14 with a shorter sidewall can be attached properly to the tray support device 10. The mounting leg 40, as shown in FIG. 4, includes an inner surface 42 and an outer surface 44. The inner surface 42 is adapted to allow the first surface 62 of the first tray clamp member 60 to slide vertically along the inner surface 42 so the first tray clamp member 60 can be positioned to accept the lip 15 of the tray 14. The mounting leg 40, as shown in FIG. 2, includes three elongated slots 46, 47 and 48 that allow fasteners 38 and 39 to pass therethrough, The elongated slots 46–48 allow adjustment of the tray support device 10 so the tray 14 can be properly fitted to the device 10 and leveled with the ground. The outer surface 44, as shown in FIG. 4, includes a plurality of vertical ribs 49 which add strength to the mounting leg 40. The outer surface 44 comes in contact with an outside surface 19 of the side rail 16 when the tray support device 10 is clamped to the ladder 12, as shown in FIG. 1.

Also forming part of the tray support device is a z-shaped bracket 60 designated as a first tray clamp member. The tray clamp member 60 defines a pair of apertures 63 and 64 through which fasteners 38 and 39 may extend. As best shown in FIG. 4. Another aperture 65 is provided in an upwardly extending flange 66 also adapted to receive fasteners 38 or 39 therethrough. The first tray clamp member 60 defines a first surface 62 adapted to slide vertically along the inner surface 42 of the mounting leg 40. The first tray clamp member 60 further includes a vertically extending notch 67, best shown in FIG. 2, or groove in the lower end of the first tray clamp member 60 adapted to fit over the support leg rib 59 that passes through the recess 57 of the support leg 52 so as to prevent relative rotation between the first tray clamp member 60 and the support leg 52.

The first tray clamp member 60 also includes an L-shaped shelf 68, as shown if FIG. 4 defined by an outwardly extending leg 69 and an upwardly extending leg 70. The upwardly extending leg 70, the outwardly extending leg 69 and the flange 66 together form a channel 7l, shown in FIG. 3, that accepts the paint tray lip 15 to allow attachment of the tray support device 10 to the tray 14.

Also forming part of the tray support device 10 is a L-shaped bracket 80 designated as a second tray clamping member, as shown in FIG. 4. The second tray clamping member 80 defines an aperture 82 through which either fastener 38 or 39 extends therethrough. The second tray clamping member 80 further includes an outer surface 84 and an inner surface 86 wherein the inner surface contains a flange 88 that contacts the inside surface of the edge of the tray 14 at the same position on the tray 14 as the first tray clamp member 60, as shown in FIG. 3. The outwardly extending flange 88 extends downwardly from the body of the second tray clamping member 80 and creates an L-shape. When fasteners 38 and 39 are tightened, the first tray clamping member 60 and the second tray clamping member 80 clasp the edge of the tray 14 to prevent movement.

When the fasteners 38 and 39 are tightened, the first clamping member 18, the mounting leg 40, the first tray clamp member 60 and the second tray clamp member 80 are drawn together to solidify the tray support device 10 to prevent movement when mounted to the ladder 12 and the tray 14. To mount the tray 14 to the tray support device 10, fasteners 38 and 39 are loosened so the second tray clamp member 80 can be separated from the first tray clamp member 60, as best displayed in the exploded view in FIG. 4, and the first tray clamp member 60 can be vertically slid along the inner surface 42 of the mounting leg 40. The lip 15 of the paint tray 14 is positioned between the first tray clamp member 60 and the second tray clamp member 80 where the lip rests in the channel 71 of the first tray clamp member 60 and the second tray clamp member 80 inner surface 86 comes in contact with the inner portion of the edge of the tray 14. The tray 14, first tray clamp member 60 and second tray clamp member 80 are advanced downward until the bottom of the tray comes in contact with the top surface 55 of the support leg 52. When the bottom of the tray 14 reaches this position, the fasteners 38 and 39 are tightened so the first tray clamp member 60 and the second tray clamp member 80 clench the lip and inner surface of the paint tray 14.

To attach the tray support device 10 to the side rail 17 of the ladder 12, fasteners 38 and 39 are loosened so that the first tray clamping member 18 can be separated from the outer surface 44 of the mounting leg 40. Since the apertures 24 and 26 have a diameter larger than fasteners 38 and 39, an operator can easily separate the first champing member 18 by simply grabbing and sliding the member 18 in the direction away from the mounting leg 40. The tray support device 10 is then positioned so the front surface 20 of the first clamping member 18 and the outer surface 44 of the mounting leg 40 are in contact with the inside surface 17 and the outside surface 19 of the ladder side rail 16. The tray support device 10 is pivoted slightly until the tray 14 is parallel to the ground. When the tray 14 is in the proper position, fasteners 38 and 39 are tightened to compress the inside surface 17 and outside surface 19 of the ladder side rail 16.

In certain situations, it may be desirable to position the tray holding device 10 on either the right or left hand side of the ladder depending on the amount of space available where the ladder 12 is placed or whether the operator is right or left handed.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A tray support device adapted to be adjustably attached to a ladder for supporting a tray, the tray support device including:

a mounting leg;

a first ladder clamping member positioned adjacent to said mounting leg and adapted to secure a portion of the ladder between said first clamping member and said mounting leg;

a first fastener between said first clamping member and said mounting leg adapted to vary a distance between said first clamping member and said mounting leg;

a support leg attached to and extending laterally from said mounting leg for supporting the tray;

first and second tray clamping members positioned adjacent to said mounting leg and adapted to secure the tray to said mounting leg; and a second fastener between said first and second tray clamping members and said mounting leg adapted to vary a distance between said first and second tray clamping members and said mounting leg to releasably secure the tray to the mounting leg and to the ladder.

2. The tray support device of claim 1 wherein said first and second tray clamping members cooperate to capture a lip and a portion of a sidewall of the tray between said first and second tray clamping members.

3. The tray support device of claim 1 wherein said first and second tray clamping members include a plurality of apertures for attachment to said mounting leg with said second fastener.

4. The tray support device of claim 1 wherein said first and said second fasteners further include a plurality of bolts and adjustment knobs to allow for adjustment of said first clamping member, said mounting leg, and said first and second tray clamping members.

5. The tray support device of claim 1 wherein said mounting leg includes a plurality of slots therein for the passage of a plurality of bolts.

6. The tray support device of claim 1 wherein said first ladder clamping member contains a plurality of apertures for attachment to said mounting leg.

7. The tray support device of claim 1 wherein said mounting leg is adjustably attached to said first clamping member and said first and second tray clamping members by a plurality of bolts and adjustment knobs.

8. The tray support device of claim 1 wherein said mounting leg includes a series of vertically extending ridges to add structural strength.

9. A container support device adapted to be adjustably attached to a ladder for supporting a container, the container support device including:

a mounting leg;

a first ladder clamping member positioned adjacent to said mounting leg and adapted to engage a portion of the ladder between said first clamping member and said mounting leg;

a first fastener between said first clamping member and said mounting leg adapted to vary a distance between said first clamping member and said mounting leg;

a support leg attached to and extending laterally from said mounting leg for supporting the container;

first and second container clamping members positioned adjacent to said mounting leg and adapted to secure the container to said mounting leg; and a second fastener between said first and second container clamping members and said mounting leg adapted to vary a distance between said first and second container clamping members and said mounting leg.

* * * * *